US010159301B2

(12) United States Patent
Catlett

(10) Patent No.: US 10,159,301 B2
(45) Date of Patent: Dec. 25, 2018

(54) SHOE SYSTEM WITH INTERCHANGEABLE UPPERS

(71) Applicant: Kimberly Ann Catlett, Meridian, ID (US)

(72) Inventor: Kimberly Ann Catlett, Meridian, ID (US)

( * ) Notice: Subject to any disclaimer, the term of this patent is extended or adjusted under 35 U.S.C. 154(b) by 584 days.

(21) Appl. No.: 13/774,957

(22) Filed: Feb. 22, 2013

(65) Prior Publication Data

US 2013/0219751 A1 Aug. 29, 2013

Related U.S. Application Data

(60) Provisional application No. 61/602,474, filed on Feb. 23, 2012.

(51) Int. Cl.
*A43B 3/24* (2006.01)
*A43B 3/12* (2006.01)

(52) U.S. Cl.
CPC ..... *A43B 3/244* (2013.01); *A43B 3/122* (2013.01)

(58) Field of Classification Search
CPC ..... A43B 3/122; A43B 3/24; A43B 3/242; A43B 3/244; A43B 13/36
USPC ..... 36/7.5, 11.5, 23, 100, 101; 24/265 A, 24/265 B, 265 C, 265 R, 458
See application file for complete search history.

(56) References Cited

U.S. PATENT DOCUMENTS 1,257,061 A * 2/1918 Brockett et al. ..... B65D 73/00 206/341
2,112,761 A 3/1938 Buehner
2,221,132 A 11/1940 Girardi
2,329,974 A * 9/1943 Bennett ..... B42F 9/001 24/458
2,367,232 A 1/1945 Marx
2,368,314 A 1/1945 Marx
2,519,108 A * 8/1950 Bryant ..... A43B 3/24 36/101
2,566,886 A * 9/1951 Hartman ..... F16B 2/246 24/458
2,607,133 A 8/1952 Marlowe
2,761,224 A * 9/1956 Gardiner ..... A43B 3/122 36/101

(Continued)

FOREIGN PATENT DOCUMENTS

EP 2367232 A2 * 9/2011 ..... H01Q 1/12
GB 2147792 A * 5/1985 ..... A43B 3/12
WO WO 0184973 A1 * 11/2001 ..... A43B 3/24

OTHER PUBLICATIONS

ETSY, "Handmade Interchangeable Sandals", http://www.etsy.com/listing/81825766/size-4-moped-by-mohop-handmade, Jan. 18, 2012.

*Primary Examiner* — Khoa Huynh
*Assistant Examiner* — James Heracklis
(74) *Attorney, Agent, or Firm* — Parsons Behle & Latimer

(57) ABSTRACT

Disclosed is a shoe system which comprises a shoe, at least one clip, and at least one detachable upper. The shoe has a midsole portion having a sidewall surface extending around the shoe, and at least one elongated channel defined in and extending along at least a portion of the sidewall surface. The elongated channel is configured for receiving the clip in a locking fashion. The clip has a locking portion for locking within the channel. The clip connects with the detachable upper via a connection portion.

20 Claims, 11 Drawing Sheets

(56) References Cited

U.S. PATENT DOCUMENTS 2,976,623 A * 3/1961 Gallaway ..... A43B 3/122 36/100
2,993,188 A * 7/1961 Anderson ..... H01R 13/40 24/265 A
3,000,116 A 9/1961 Ally
3,032,896 A 5/1962 Weaver
3,154,866 A 11/1964 Laufbahn
3,204,346 A * 9/1965 Lockard ..... A43B 3/244 36/101
3,553,754 A 1/1971 Mendelsohn
3,599,353 A 8/1971 Magidson
3,878,626 A * 4/1975 Isman ..... A43B 1/0054 36/15
3,925,915 A 12/1975 Colli
4,062,132 A * 12/1977 Klimaszewski ..... A43B 13/36 36/100
4,103,440 A 8/1978 Lawrence
4,297,798 A * 11/1981 Colan ..... A43B 3/24 36/101
4,450,633 A * 5/1984 Connelly ..... A43B 1/0054 36/101
4,461,102 A 7/1984 DeVincentis
4,525,940 A 7/1985 Mochizuki
4,839,948 A 6/1989 Boros
4,887,369 A 12/1989 Bailey et al.
5,029,788 A * 7/1991 Hoskinson ..... A47G 1/20 24/377
5,317,822 A * 6/1994 Johnson ..... A43B 13/36 36/101
5,337,491 A * 8/1994 Mascotte ..... A43B 3/16 36/7.1 R
5,339,543 A * 8/1994 Lin ..... A43B 13/12 36/100
D384,495 S 10/1997 Watson
5,802,738 A * 9/1998 Ferniani ..... A43B 3/103 36/101
5,896,684 A * 4/1999 Lin ..... A43B 3/103 36/101
5,992,058 A * 11/1999 Jneid ..... A43B 3/122 36/100
6,299,962 B1 10/2001 Davis et al.
6,349,486 B1 * 2/2002 Lin ..... A43B 3/122 36/101
6,418,643 B1 * 7/2002 Yang ..... A43B 3/0078 36/101
6,430,846 B1 * 8/2002 Lin ..... A43B 3/122 24/640
6,499,234 B2 * 12/2002 Manzi ..... A43B 3/122 36/100
6,581,255 B2 6/2003 Kay
6,640,373 B2 * 11/2003 Tsai ..... A43B 3/122 12/142 S
6,640,464 B2 11/2003 Hsin et al.
6,848,199 B1 * 2/2005 Giannelli ..... A43B 13/36 36/101
7,168,189 B2 1/2007 Phelan
7,219,445 B2 * 5/2007 Stern ..... A43B 3/103 36/100
7,272,897 B2 * 9/2007 Yu ..... 36/11.5
7,318,289 B2 1/2008 Chan
7,347,010 B2 * 3/2008 Yu ..... A43B 1/0036 36/100
D575,051 S 8/2008 Barteet
7,584,555 B2 9/2009 Pearce
D602,685 S 10/2009 Barteet
7,681,330 B2 * 3/2010 Lewis ..... A43B 3/103 36/100
7,698,834 B1 * 4/2010 Courville ..... A43B 3/24 36/100
7,810,253 B2 10/2010 Barteet
7,877,903 B2 2/2011 Barteet
7,900,379 B2 * 3/2011 Lafortune ..... A43B 7/142 36/100
7,954,260 B2 6/2011 Enderson
8,001,664 B2 8/2011 Pearce
8,171,654 B2 * 5/2012 Rudd, Jr. ..... A43B 3/103 36/101
8,250,780 B1 * 8/2012 Diaz ..... A43B 3/122 36/101
8,438,758 B2 * 5/2013 Stonisch ..... A43B 3/12 36/100
2002/0194750 A1 * 12/2002 Feick ..... A43B 3/122 36/101
2003/0145490 A1 * 8/2003 Tsai ..... A43B 3/244 36/15
2003/0177664 A1 * 9/2003 Monassebian ..... A43B 1/0027 36/100
2003/0192205 A1 * 10/2003 Linens ..... A43B 1/0027 36/100
2003/0200675 A1 * 10/2003 Gross ..... A43B 1/0081 36/15
2003/0233772 A1 12/2003 Musial
2004/0064976 A1 * 4/2004 Barteet ..... A43B 3/103 36/100
2004/0118016 A1 * 6/2004 Tonkel ..... A43B 3/102 36/11.5
2004/0187346 A1 * 9/2004 Bianchi ..... A43B 3/122 36/11.5
2005/0039344 A1 * 2/2005 Berg ..... A43B 1/0027 36/11.5
2005/0055844 A1 * 3/2005 Yu ..... A43B 1/0036 36/19 R
2006/0112596 A1 * 6/2006 Chan ..... A43B 3/103 36/100
2006/0242861 A1 * 11/2006 Dushey ..... A43B 3/103 36/101
2007/0240335 A1 * 10/2007 Fitzgerald ..... A43B 3/24 36/101
2007/0240336 A1 * 10/2007 Richardson ..... A43B 1/0054 36/101
2007/0261267 A1 11/2007 Osborn
2008/0060227 A1 * 3/2008 Enderson ..... A43B 3/103 36/100
2008/0072456 A1 * 3/2008 Pearce ..... A43B 3/122 36/101
2008/0098623 A1 * 5/2008 Komitau ..... A43B 3/244 36/101
2008/0235992 A1 * 10/2008 Stefani ..... A43B 3/24 36/101
2010/0018079 A1 * 1/2010 Albert ..... A43B 3/122 36/101
2010/0037486 A1 * 2/2010 Verheijen ..... A43C 11/1493 36/101
2010/0122474 A1 5/2010 Wolf et al.
2010/0139123 A1 * 6/2010 Alan ..... A43B 3/24 36/100
2010/0251570 A1 * 10/2010 Berrins ..... A43B 3/24 36/101
2012/0079738 A1 * 4/2012 Alberi ..... A43B 3/122 36/11.5
2013/0219751 A1 * 8/2013 Catlett ..... A43B 3/122 36/101

* cited by examiner

SHOE SYSTEM WITH INTERCHANGEABLE UPPERS

PRIORITY/CROSS-REFERENCE TO RELATED APPLICATIONS

This application claims the benefit of U.S. Provisional Application No. 61/602,474, filed 23 Feb. 2012, the disclosure of which is incorporated by reference.

TECHNICAL FIELD

The disclosure generally relates to the field of footwear. Particular embodiments relate to a footwear upper connection device system that allows a user to easily and securely change and attach one or more vamps or heel straps onto the midsole of a shoe.

BACKGROUND

Traditionally, shoes have permanent vamps (uppers) which attach to the midsole of the shoe. If any part of the vamp or heel strap element becomes damaged, a traditional shoe becomes essentially unusable. Further, traditional shoes do not allow a user to move and adjust straps to create a custom fit, meaning the shoe may not fit the foot properly or comfortably.

The prior art does disclose a number of prior attempts at creating a shoe system having interchangeable uppers, for instance U.S. Pat. No. 7,877,903 (Barteet) and U.S. Pat. No. 8,001,664 (Pearce).

SUMMARY OF THE DISCLOSURE

Several exemplary shoe systems having interchangeable uppers are described herein. The exemplary shoes systems include a strap connection system that offers a plurality of shoe design options for the user. The systems provide the ability to modify the location of the straps (and other vamps) in that they are generally connecting the straps to a fixed point. The straps can be connected to the shoe base anywhere along a channel on the shoe base. This gives the user ultimate flexibility in the placement and design of the straps.

An exemplary system may come as a shoe base with several different straps that can be configured based on the wearer's preference. The shoe base (midsole) includes a channel, preferably defined all the way around, which allows the straps to be clipped in at any interval. A vamp connecting clip allows the wearer to re-position the straps easily and modify the overall look of the shoe in seconds. The strap system and clip provide for easy removal, yet are not subject to unintentional disengagement.

The system includes a recessed channel that goes around the entire base (midsole) of the shoe. The clip, which is connected to a vamp, is inserted into the channel and locked in place. The vamp can be removed by pressing the clip down beyond the edge of the ridge and pulling back. The channel and clip fit perfectly together. The channel (female connector) offers a receptacle and the clip (male connector) provides the removable fastener.

One exemplary shoe system having interchangeable uppers comprises a shoe, at least one clip, and at least one detachable upper. The shoe has a midsole portion which comprises a sidewall surface extending around the shoe, and at least one elongated channel defined in and extending along at least a portion of the sidewall surface. The elongated channel comprises an opening into the channel. The elongated channel is configured for receiving the clip therein in a locking fashion. The clip comprises a locking portion for locking within the channel. The clip connects with the detachable upper via a connection portion. The detachable upper comprises an attachment portion for connecting with the connection portion via a connector.

Preferably, the at least one elongated channel extends around the entire sidewall surface of the midsole portion. Preferably, the at least one elongated channel comprises at least two elongated channels, namely a first channel on an outside portion of the sidewall surface and a second channel on an inside portion of the sidewall surface. Preferably, the elongated channel is generally right triangular in shape, comprising a base portion, an upwardly extending roof portion and a downwardly extending roof portion, where the base portion is oriented along the hypotenuse of the generally right triangular shape, and where the opening is defined through an acute corner of the generally right triangular shape. Preferably, the locking portion is configured for insertion through the opening and into the elongated channel. Preferably, the locking portion is generally right triangular shaped, having a deflectable leg connecting to a fixed leg at a nose, the fixed leg connecting to an upright at a locking corner, and the opening is located between the upright and the deflectable leg. Preferably, the deflectable leg is oriented along the hypotenuse of the generally right triangular shape. Preferably, the deflectable leg is shorter than the fixed leg. Preferably, the deflectable leg can be deflected towards the fixed leg when inserted into the opening and when removed from the opening. Preferably, the connector portion further connects with the upright. Preferably, the clip can be locked into the channel by inserting the nose through the opening with the deflectable leg adjacent the base, wherein as it is inserted the deflectable leg will deflect towards the fixed leg until the locking corner passes the overhang rim and the locking portion is able to snap into the channel as the deflectable leg resiliently deflects away from the fixed leg; and wherein the clip can be removed from the channel by applying downward pressure on the connector portion thereby moving the fixed leg towards the deflectable leg and allowing the locking corner to be drawn past the overhang rim and through the opening. Preferably, the locking portion nests within the channel when locked therein.

Another exemplary shoe system having interchangeable uppers comprises a shoe, at least one clip, and at least one detachable upper. The shoe comprises a midsole portion having a sidewall surface and at least one elongated channel defined in and extending around the shoe. The elongated channel comprises an opening. The elongated channel configured for receiving the clip in a locking fashion. The clip comprises a locking portion for locking within the channel. The clip connecting with the detachable upper via a connection portion. The locking portion is configured for insertion through the opening and into the elongated channel. The locking portion is generally right triangular shaped, comprising a deflectable leg connecting to a fixed leg at a nose, the fixed leg connecting to an upright at a locking corner, with the opening located between the upright and the deflectable leg. The detachable upper comprises an attachment portion for connecting with the connection portion via a connector.

Optionally, the deflectable leg is oriented along the hypotenuse of the generally right triangular shape wherein the deflectable leg is shorter than the fixed leg, and wherein the deflectable leg can be deflected towards the fixed leg when inserted into the opening and when removed from the opening. Optionally, wherein the connector portion further connects with the upright. Optionally, the clip can be locked into the channel by inserting the nose through the opening with the deflectable leg adjacent the base, wherein as it is inserted the deflectable leg will deflect towards the fixed leg until the locking corner passes the overhang rim and the locking portion is able to snap into the channel as the deflectable leg resiliently deflects away from the fixed leg; and wherein the clip can be removed from the channel by applying downward pressure on the connector portion thereby moving the fixed leg towards the deflectable leg and allowing the locking corner to be drawn past the overhang rim and through the opening. Optionally, the at least one elongated channel extends around the entire sidewall surface of the midsole portion. Optionally, the at least one elongated channel comprises at least two elongated channels, namely a first channel on an outside portion of the sidewall surface and a second channel on an inside portion of the sidewall surface. Optionally, the elongated channel is generally right triangular in shape, comprises a base portion, an upwardly extending roof portion and a downwardly extending roof portion, wherein the base portion is oriented along the hypotenuse of the generally right triangular shape, and wherein the opening is defined through an acute corner of the generally right triangular shape.

Another exemplary shoe system having interchangeable uppers comprises a shoe, at least one clip, and at least one detachable upper. The shoe comprises a midsole portion, the midsole portion comprises a sidewall surface and at least one elongated channel defined in and extending along at least a portion of the sidewall surface. The elongated channel comprises an opening. The elongated channel configured for receiving the clip in a locking fashion. The elongated channel is generally right triangular in shape, and comprises a base portion, an upwardly extending roof portion and a downwardly extending roof portion. The base portion is oriented along the hypotenuse of the generally right triangular shape. The opening is defined through an acute corner of the generally right triangular shape. The clip comprises a locking portion for locking within the channel. The clip connecting with the detachable upper via a connection portion. The locking portion configured for insertion through the opening and into the elongated channel. The locking portion is generally right triangular shaped, comprises a deflectable leg connecting to a fixed leg at a nose, and the fixed leg connecting to an upright at a locking corner. The opening is located between the upright and the deflectable leg. The deflectable leg is oriented along the hypotenuse of the generally right triangular shape. The deflectable leg is shorter than the fixed leg. The deflectable leg can be deflected towards the fixed leg when inserted into the opening and when removed from the opening. The connector portion further connects with the upright. The clip can be locked into the channel by inserting the nose through the opening with the deflectable leg adjacent the base, as it is inserted the deflectable leg will deflect towards the fixed leg until the locking corner passes the overhang rim and the locking portion is able to snap into the channel as the deflectable leg is resiliently deflected away from the fixed leg. The clip can be removed from the channel by applying downward pressure on the connector portion thereby moving the fixed leg towards the deflectable leg and allowing the locking corner to be drawn past the overhang rim and through the opening. The detachable upper comprises an attachment portion for connecting with the connection portion via a connector.

Additional understanding of the devices contemplated and/or claimed by the inventor can be gained by reviewing the detailed description of exemplary devices, presented below, and the referenced drawings.

DETAILED DESCRIPTION

The following description and the referenced drawings provide illustrative examples of that which the inventor regards as her invention. As such, the embodiments discussed herein are merely exemplary in nature and are not intended to limit the scope of the invention, or its protection, in any manner. Rather, the description and illustration of these embodiments serve to enable a person of ordinary skill in the relevant art to practice the invention.

The use of "e.g.," "etc," "for instance," "in example," "for example," and "or" and grammatically related terms indicates non-exclusive alternatives without limitation, unless otherwise noted. The use of "including" and grammatically related terms means "including, but not limited to," unless otherwise noted. The use of the articles "a," "an" and "the" are meant to be interpreted as referring to the singular as well as the plural, unless the context clearly dictates otherwise. Thus, for example, reference to "a clip" includes two or more such clips, and the like. The use of "optionally," "alternatively," and grammatically related terms means that the subsequently described element, event or circumstance may or may not be present/occur, and that the description includes instances where the element, event or circumstance occurs and instances where it does not. The use of "preferred," "preferably," and grammatically related terms means that a specified element or technique is more acceptable than another, but not that such specified element or technique is a necessity, unless the context clearly dictates otherwise. The use of "exemplary" means "an example of" and is not intended to convey a meaning of an ideal or preferred embodiment.

Disclosed are several exemplary shoe systems having interchangeable uppers, each generally referred to herein as a "shoe system."

Figure 1:
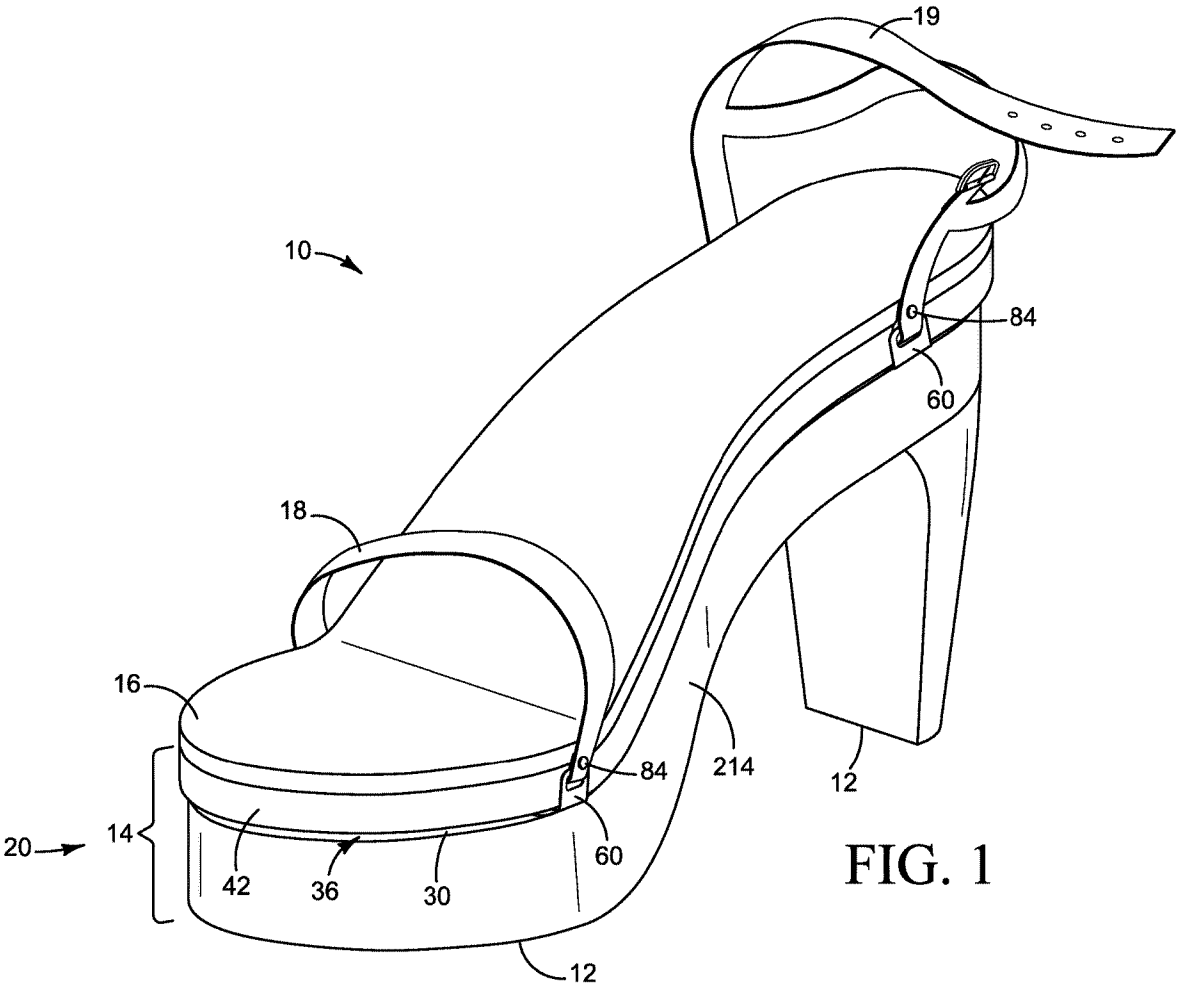
FIG. 1 is a front perspective view of a first exemplary shoe system having interchangeable uppers.
Figure 2:
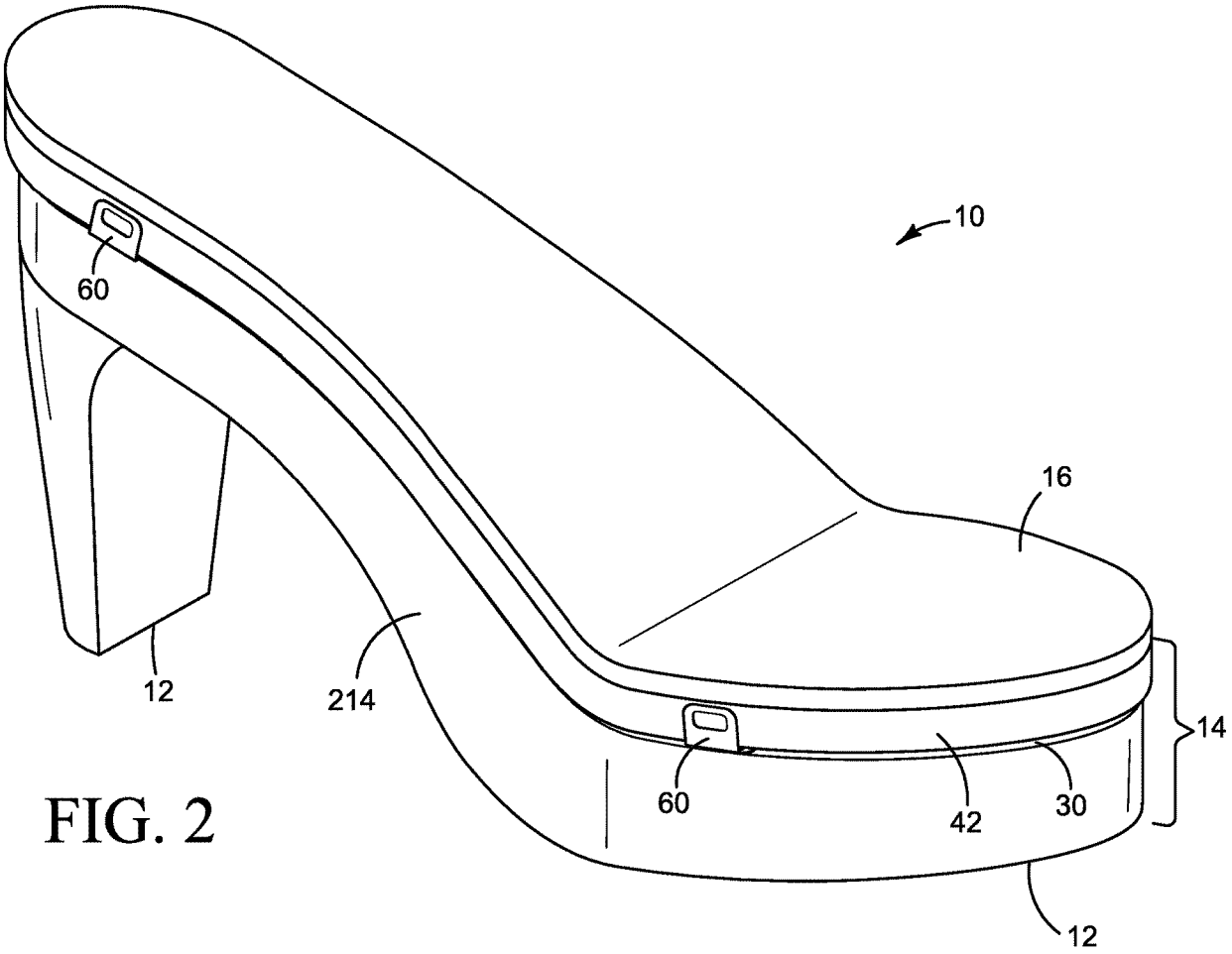
FIG. 2 is a rear perspective view of the exemplary shoe system of FIG. 1, illustrated without an upper (vamp) installed.

A first exemplary shoe system is illustrated in FIGS. 1 through 11. Referring first to FIGS. 1 and 2, the shoe system 10 comprises an outsole 12, a midsole 14, an insole 16, and at least one vamp 18, 19. The outsole 12, midsole 14, and insole 16 collectively making up the shoe base 20.

Outsoles and insoles are common components in footwear, and a skilled artisan will be able to select an appropriate configuration, structure and material for the outsoles/insoles in a particular embodiment based on various considerations, including the intended use of the footwear, the intended arena within which the footwear will be used, and the equipment and/or accessories with which the footwear is intended to be used, among other considerations.

The midsole 14 comprises at least one sidewall surface 42 extending around the shoe base 20. The midsole 14 comprises at least one elongated channel 30 having an opening 36, the elongated channel 30 defined in and extending through the sidewall surface 42 and into the midsole 14. The elongated channel 30 extends around at least a portion of the midsole. The elongated channel 30 is configured for receiving at least one clip 60 therein in a locking fashion.

In the shoe system 10 illustrated in FIGS. 1 through 11, a single elongated channel 30 extends around the entire midsole 14. In other exemplary shoe systems, a plurality of elongated channels may be present, for instance, one exemplary shoe system could comprise at least two elongated channels, namely a first channel on an outside portion of the sidewall surface (outside (lateral side) of the shoe) and a second channel on an inside portion of the sidewall surface (inside (medial side) of the shoe). In other exemplary shoe systems the elongated channel(s) may extend around a portion of the midsole instead of around the entire midsole. A skilled artisan will be able to select an appropriate location and configuration for the one or more elongated channel(s) in a particular shoe system embodiment based on various considerations, including the intended use of the shoe system, the intended arena within which the shoe system will be used, and the equipment and/or accessories with which the shoe system is intended to be used, among other considerations.

Figure 9:
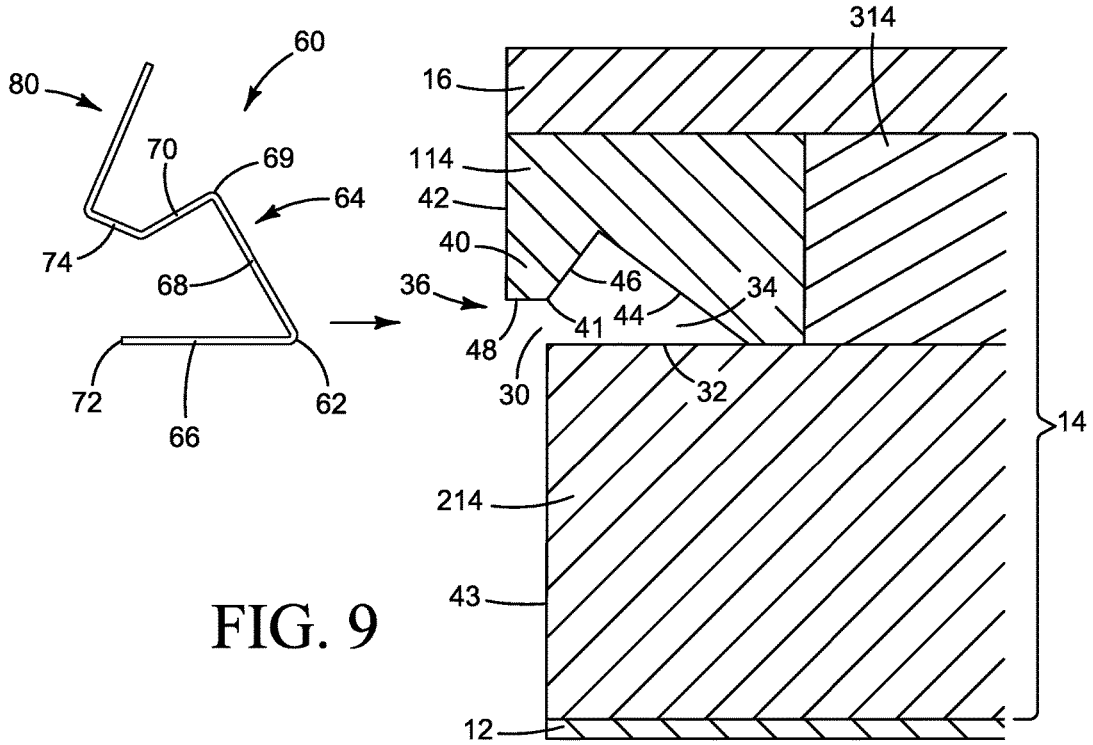
FIG. 9 is a first sequential, partial, cross sectional view of the exemplary shoe system of FIG. 6.
Figure 10:
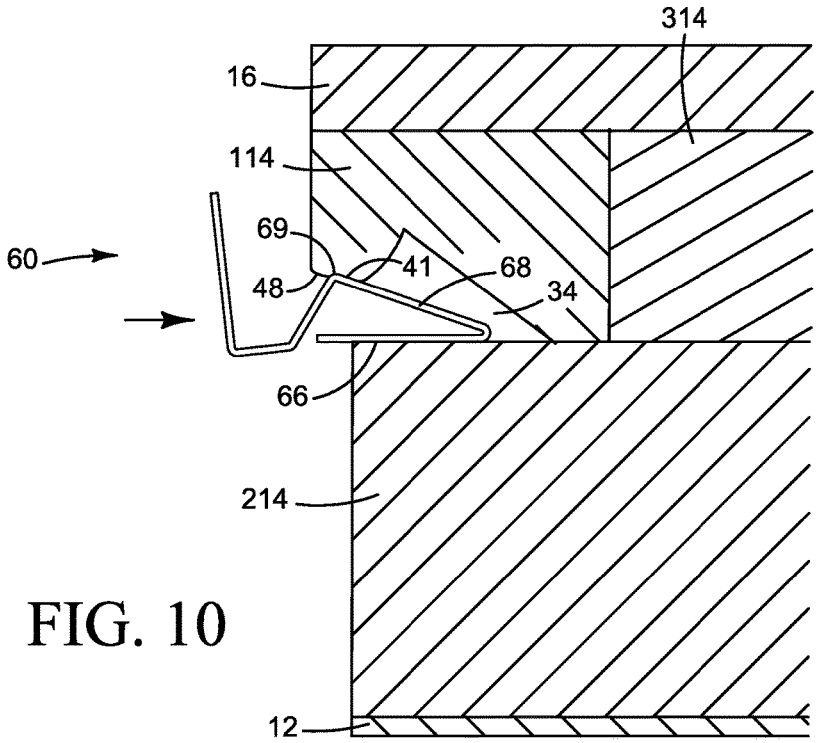
FIG. 10 is a second sequential, partial, cross sectional view of the exemplary shoe system of FIG. 6.
Figure 11:
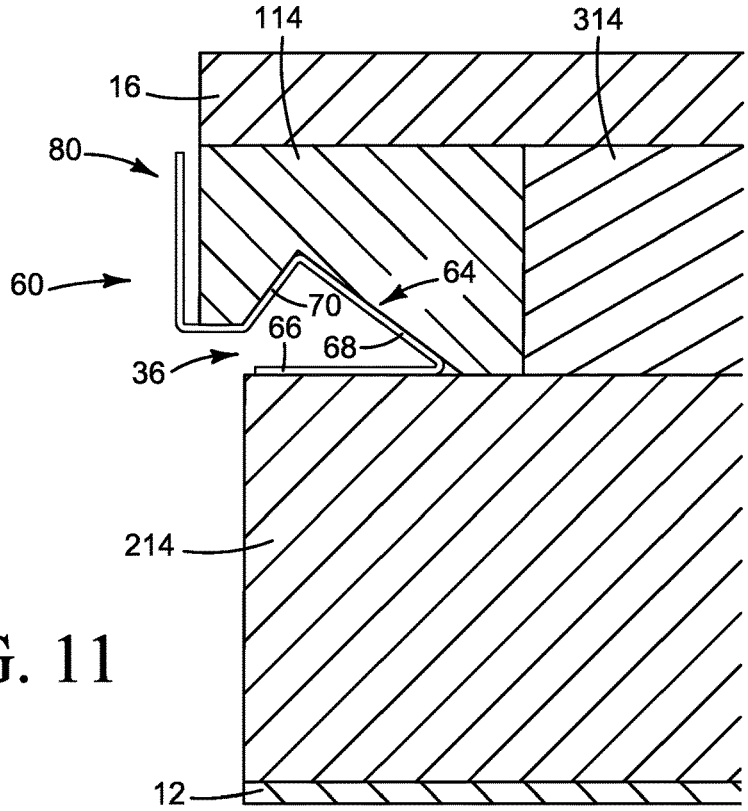
FIG. 11 is a third sequential, partial, cross sectional view of the exemplary shoe system of FIG. 6, taken along the line 12-12.

FIGS. 9 through 11 illustrate, in a cross-sectional view, the elongated channel 30 of the shoe system 10. The elongated channel 30 having an opening 36 into a channel chamber 34. The elongated channel 30 illustrated in these figures is generally right triangular in shape, having a base portion 32, an upwardly extending roof portion 44, and a downwardly extending roof portion 46. In such a configuration, the base portion 32 is oriented along the hypotenuse of the generally right triangular shape, and the opening 36 is defined through an acute corner of the generally right triangular shape. While such a generally right triangular shape is illustrated, a skilled artisan will be able to select an appropriate shape for the elongated channel in a particular embodiment based on various considerations.

As illustrated in FIGS. 9 through 11, it is preferred that the lower portion 43 of the sidewall surface 42 below the opening 36 be recessed in comparison to the portion of the sidewall surface 42 above the opening 36, so as to minimize the size of the opening 36 needed to enable the clip 60 to be inserted therethrough. In other exemplary systems, for instance the elongated channel 131 illustrated in FIG. 12, the sidewall 142 and the lower portion 143 of the sidewall 142 may be generally flush with one another.

Figure 3:
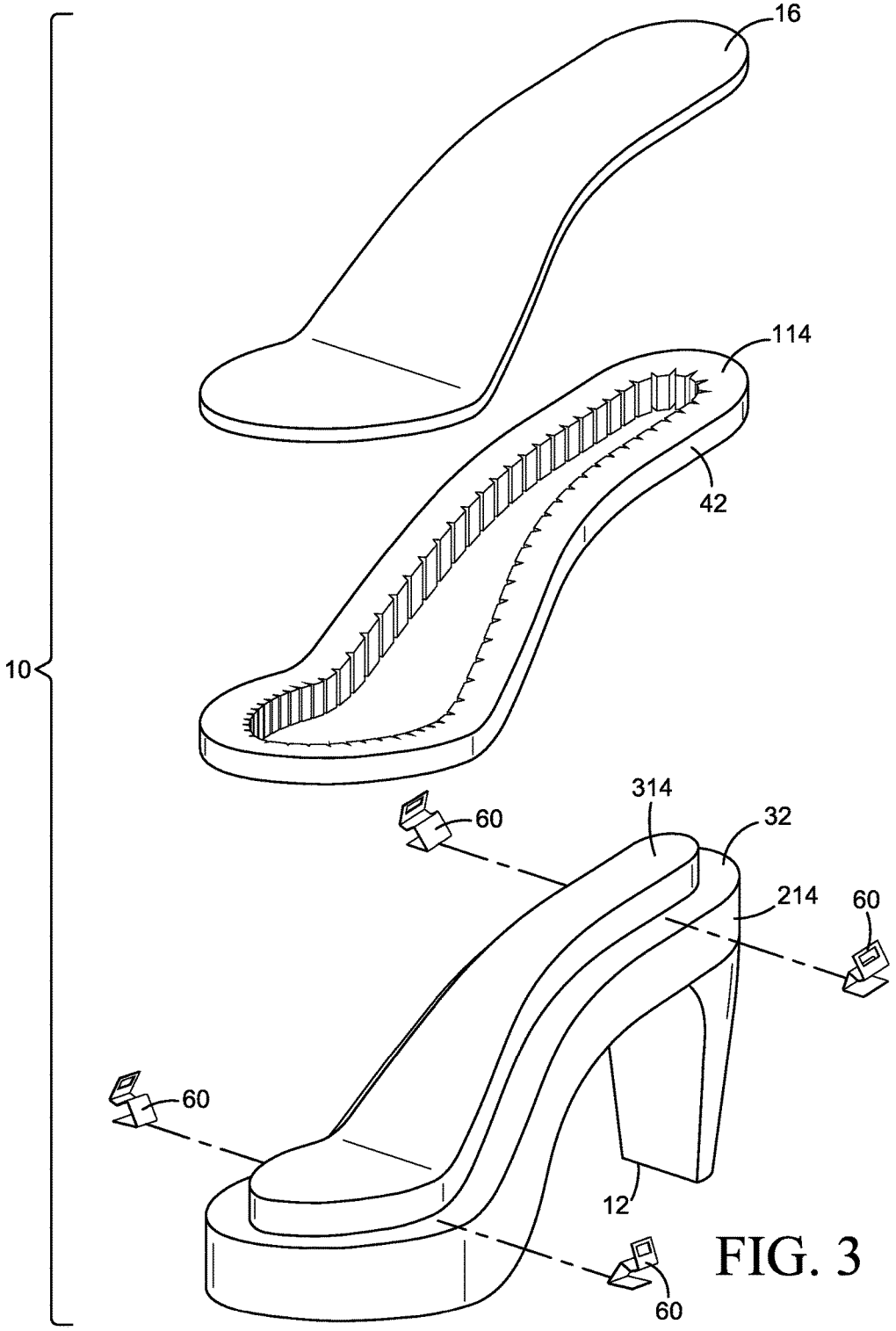
FIG. 3 is an exploded, perspective view of the exemplary shoe system of FIG. 1, illustrated without an upper (vamp) installed.

FIGS. 9 through 11 also illustrate the midsole 14, the outsole 12, and the insole 16. The midsole 14 illustrated in these figures, as well as in FIG. 3, is formed as a three separate portions, namely midsole portions 114, 214 and 314. FIG. 3 is a partial, exploded view of the exemplary shoe system of FIGS. 1 and 2, illustrating a shoe base 20 which comprises an outsole 12, a midsole (comprised of midsole portions 114, 214 and 314), and an insole 16. The midsole portions 114, 214 and 314 combining together to form the midsole. The upper surface of the midsole portion 214 forming the base portion 32 of the elongated channel 30.

Figures 4, 5:
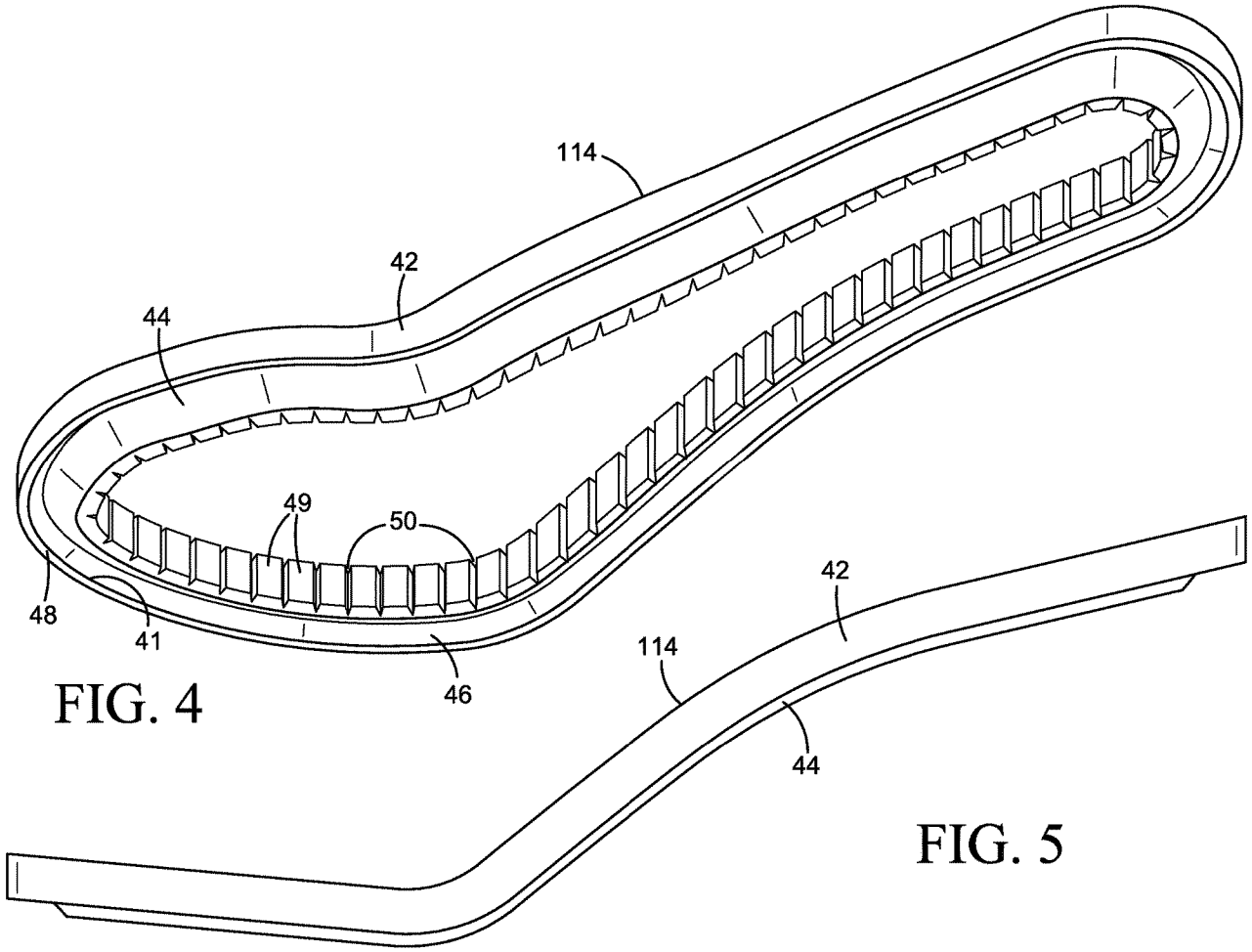
FIG. 4 is a perspective view of an exemplary midsole portion.
FIG. 5 is side view of the exemplary midsole portion of FIG. 4.

The underside of the midsole portion 114 is illustrated in FIG. 4, whereas FIG. 5 illustrates a side view. The midsole portion 114 comprises the sidewall surface 42, an upwardly extending roof portion 44, a downwardly extending roof portion 46, and an overhang 40. The inside surface 49 of the midsole portion 114 comprises a plurality of kerfs 50, notches or grooves which are cut or otherwise formed into the inside surface 49 of the midsole portion 114. The kerfs 50 allow the midsole portion 114 to be bent and curved as necessary to form a desired shape (e.g., a shape which generally matches the contour of the midsole portion 214.

Figure 13:
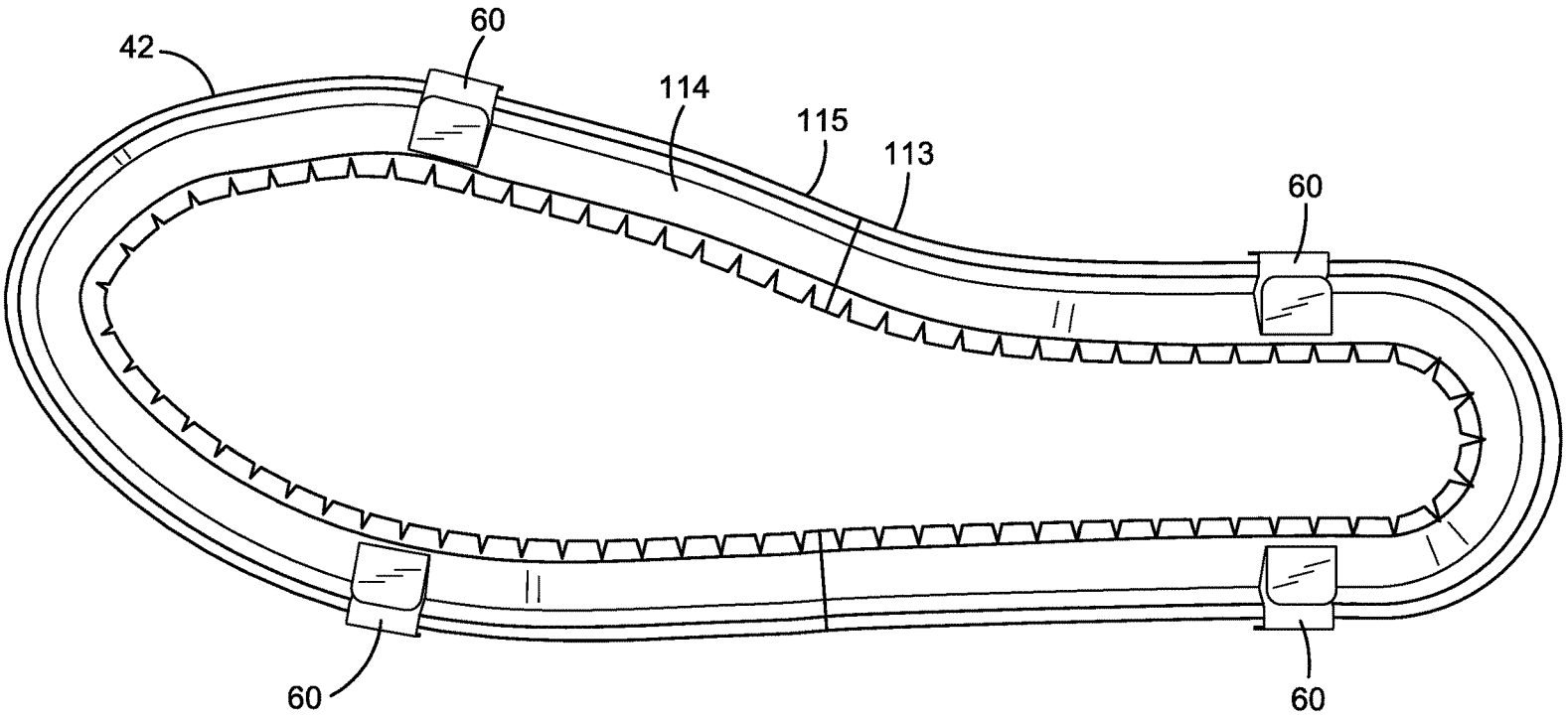
FIG. 13 is a bottom, plan view of a second exemplary midsole portion from a third exemplary shoe system.

The midsole portion 114 illustrated in FIGS. 1 through 6 comprises a single piece that could be molded or otherwise shaped. In FIG. 13, illustrated is a multi-piece midsole portion 114 which comprises a first portion 113 and a second portion 115. Such portions could be molded, extruded, or otherwise formed, and then bent into shape as necessary, with the ends trimmed if needed.

While FIG. 3 is an exploded view, FIGS. 9 through 11 illustrates the "as assembled" view. As assembled, when the midsole portion 114 is attached to the midsole portion 214, the generally right triangular elongated channel 30 is formed. The outsole 12, midsole 14, and insole 16 will be formed and/or bonded together as typically done in the manufacture of footwear. A skilled artisan will be able to select an appropriate method and material for the connection of the various components with one another in a particular embodiment based on various considerations, including, but not limited, to adhesives, mechanical fasteners, sonic welding, and melting. Alternatively, the elongated channel could be cut, molded or otherwise formed within a unitary midsole portion.

In another exemplary shoe system, retainers (not illustrated) can be defined within or otherwise placed within the elongated channel, for instance at various intervals, to assist in seating the clips and preventing them from laterally moving. In another exemplary shoe system, support reinforcements may be added within the channel in several areas, including both sides of the arch, the corners of the heel, and the corners of the toe.

Figure 6:
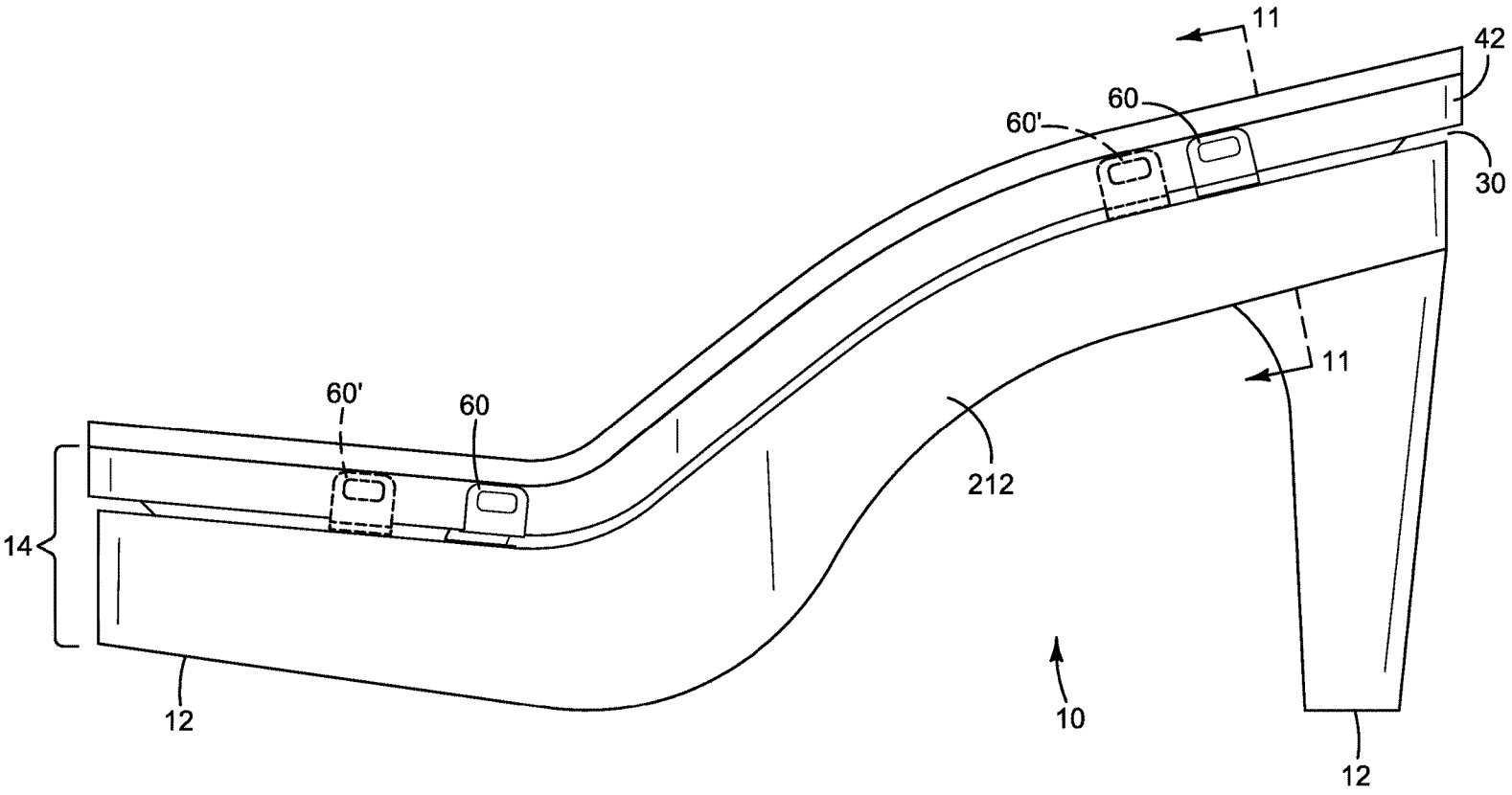
FIG. 6 is a side view of the exemplary shoe system of FIG. 1, illustrated without an upper (vamp) installed.

FIG. 6 is a side view of the exemplary shoe system 10 of FIG. 1. This figure illustrates that the clips 60 placed within the elongated channel 30 can be placed at and/or moved to multiple locations along the elongated channel 30, as represented by clips 60'.

This allows the wearer of the shoe system 10 to reconfigure the placement of the clips 60 and the vamp(s) attached thereto for aesthetics, comfort, and/or function.

Figure 7:
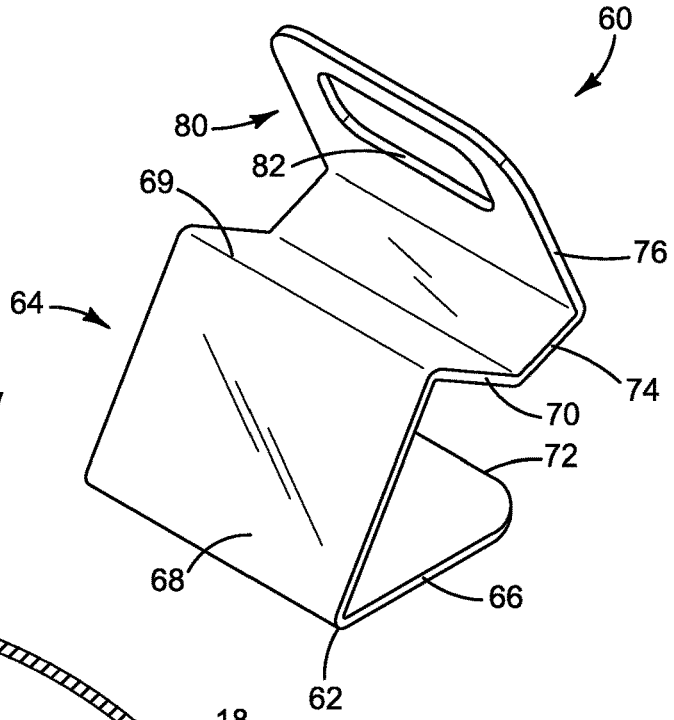
FIG. 7 is a perspective view of an exemplary clip.
Figure 8:
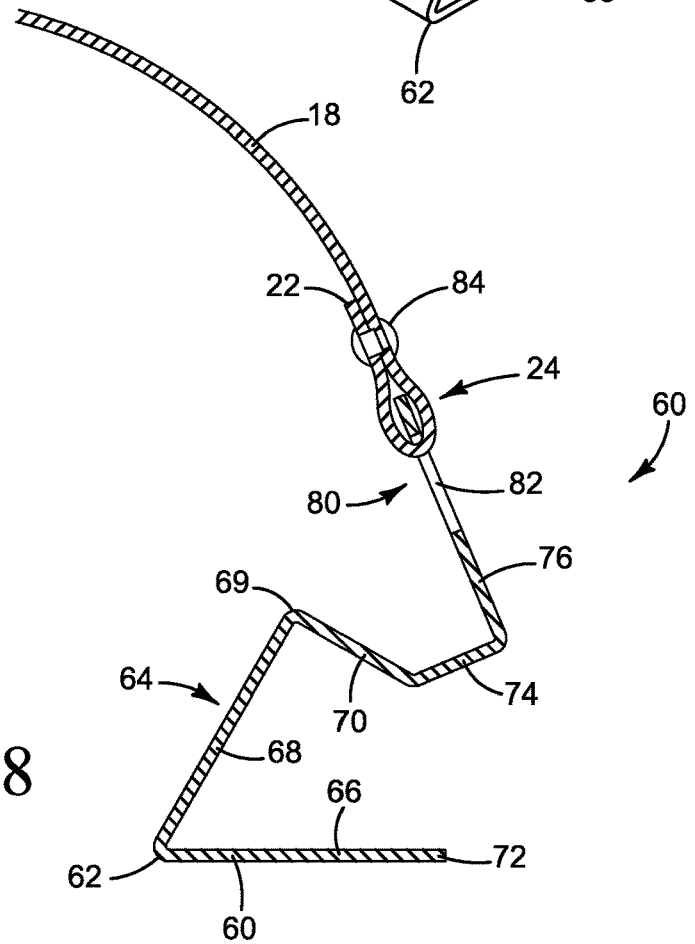
FIG. 8 is a side view of the exemplary clip of FIG. 7, illustrated with a vamp attached thereto.

FIGS. 7 and 8 illustrate an exemplary clip 60. The clip 60 of FIGS. 7 and 8 is also illustrated in FIGS. 1 through 3, 6, and 9 through 14. While this is the preferred design for a clip, a skilled artisan will be able to select an appropriate structure and configuration for a clip in a particular embodiment based on various considerations, including the intended use of the clip, the intended arena within which the clip will be used, and the equipment and/or accessories with which the clip is intended to be used, among other considerations. FIG. 15 illustrates a second exemplary clip 90 design.

The clip 60 comprises a locking portion 64 connected to a connector portion 80. The locking portion 64 is configured for insertion through an opening 36 and into an elongated channel 30, locking therein.

The locking portion 64 comprises an end 72, a deflectable leg 66, a nose 62, fixed leg 68, a locking corner 69, an upright 70, and, where necessary, an extension 74. The extension 74 for allowing the locking portion to extend past the overhang 40 and connect with the connector portion 80. The deflectable leg 66 terminates in the end 72. The deflectable leg 66 attaches to the fixed leg 68 at the nose 62. The upright 70 connects with the extension 74. The extension 74 attaches to a vertical spacer 76 which is part of the connector portion 80. The vertical spacer 76 for allowing the connection with the vamp to be spaced vertically, as desired, from the elongated channel 30.

In the illustrated clip 60, the locking portion is generally right triangular in shape, with the deflectable leg 66 oriented along the hypotenuse of the generally right triangular shape. It is preferred that the deflectable leg 66 be shorter than the fixed leg 68. The deflectable leg 66 can be deflected towards the fixed leg 68 when inserted into the opening 36, and when removed from the opening 36.

Connector portion 80 comprises one or more connectors 82 for connecting with a vamp (18, 19) via a fastener 84 or other connection device/method. Examples of fasteners include, but are not limited to, hook-and-loop fasteners, snaps, sewable loops, rivets, adhesives, and mechanical fasteners. The connector portion 80 connects with the locking portion 64 at the upright 70 and/or at the extension 74/vertical spacer 76.

It is preferred that the clip 60 be manufactured as a single, solid piece from spring steel or any other suitable material. The spring steel will preferably be coated or blued, and tumbled to ensure no sharp edges. The clip 60 may alternatively be coated with a suitable nonslip material to prevent slippage.

It is preferred that the clip 60 (having a locking portion 64) and elongated channel 30 be configured for nesting together, with the elongated channel 30 serving as a receptacle for the locking portion of the clip 60. FIGS. 9 through 11 sequentially illustrate a clip 60 being moved into engagement with an elongated channel 30.

To engage and lock the clip 60 with elongated channel 30, the deflectable leg 66 of clip 60 will be compressed towards the fixed leg 68 of clip 60, and the nose 62 inserted into the elongated channel 30 through the opening 36 with the deflectable leg 66 adjacent the base portion 32. As the clip 60 is further inserted though the opening 36, the deflectable leg 66 will continue to deflect towards the fixed leg 68. As the clip 60 is pressed further into the channel 30, the locking corner 69 will slide along the overhang 40 towards the overhang rim 41. When the locking corner 69 passes the overhang rim 41, the locking portion is able to snap into the channel 30 as the deflectable leg 66 resiliently deflects away from the fixed leg 68.

When engaged, the deflectable leg 66 of clip 60 abuts the base portion 32 of elongated channel 30, the fixed leg 68 of clip 60 abuts the upwardly extending roof portion 44 of elongated channel 30, the upright 70 of clip 60 abuts the downward extending roof portion 46 of channel 30, the extension 74 of clip 60 abuts the overhang 40 of channel 30, and the connector portion 80 of clip 60 abuts the sidewall surface 42 of the midsole 14.

The clip 60 can be removed from the channel 30 by applying downward pressure (towards the outsole 12) on the connector portion 80. This will disengage the fixed leg 68 of clip 60 from abutting the upwardly extending roof portion 44 of elongated channel 30, moving the fixed leg 68 towards the deflectable leg 66, disengaging the upright 70 from abutting the downward extending roof portion 46 of elongated channel 30, and disengaging the extension 74 from the overhang 40 of elongated channel 30. Further downwards pressure allowing the locking corner 69 to be drawn past the overhang rim 41 and through the opening 36, allowing the clip 60 to be removed from the elongated channel 30.

Figure 12:
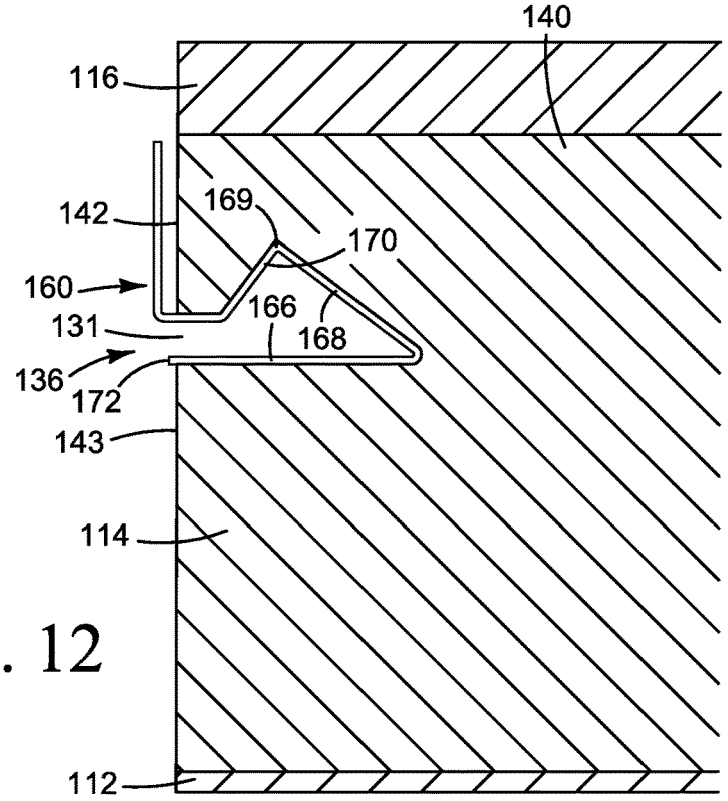
FIG. 12 is a partial, cross sectional view of a second exemplary shoe system.

Referring now to FIG. 12, illustrated is a cross-sectional view of another exemplary shoe system comprises a midsole portion 140 having an elongated channel 131 having an opening 136. The elongated channel 131 configured for receiving a clip 160 therein. The clip 160 comprises a deflectable leg 166, a fixed leg 168, and a locking corner 169. The clip 160 illustrated herein operating in the same general manner as the clip 60 previously discussed. The clip 160 having a longer deflectable leg 166 so that the end 172 of deflectable leg 166 extends beyond the lower portion 143 when the clip 160 is locked within the elongated channel 131. In such a configuration, the clip 160 would need to be compressed, as well as the material of the midsole portion 140 in order for the clip 160 to be inserted through the opening 136 into the elongated channel 131. Also illustrated in FIG. 12 are the outsole 112, midsole portion 140, and the insole 116. The midsole portion 140 illustrated as a single piece, having the elongated channel 131 formed or otherwise created therein.

FIG. 1 illustrates a pair of vamps, namely a vamp 18 which comprises a toe strap for extending over a wearer's distal foot region, and a vamp 19 which comprises a heel strap assembly. FIG. 8 illustrates that the vamp 18 comprises a strap having an attachment portion 24 and a strap end 22 which can be looped through the connector 82 of connector portion 80 of a clip 60. A fastener 84, such as a rivet, is then used to fasten the vamp 18 to the clip 60.

Figure 14:
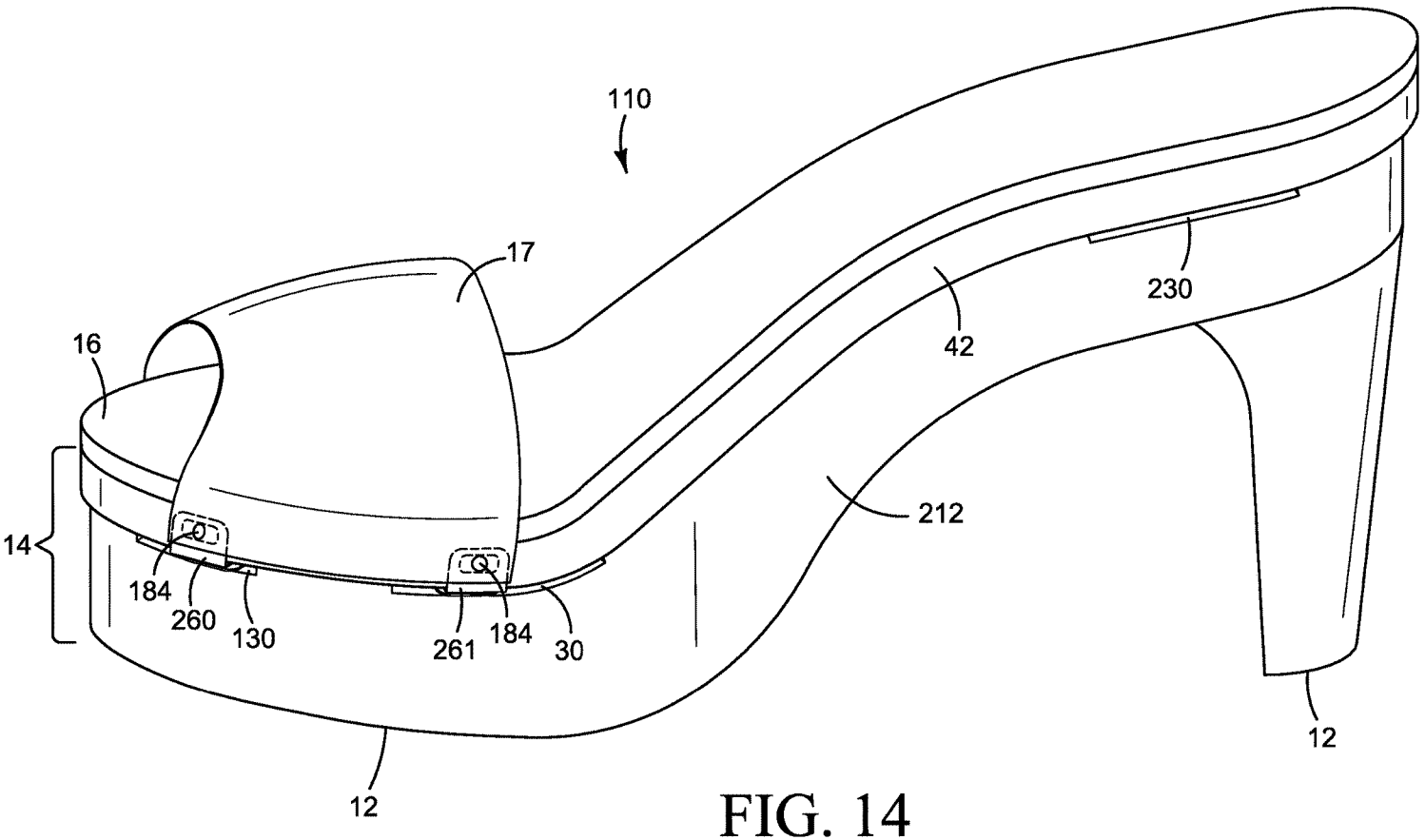
FIG. 14 is a side perspective view of a fourth exemplary shoe system, illustrated without an upper (vamp) installed.
Figure 15:
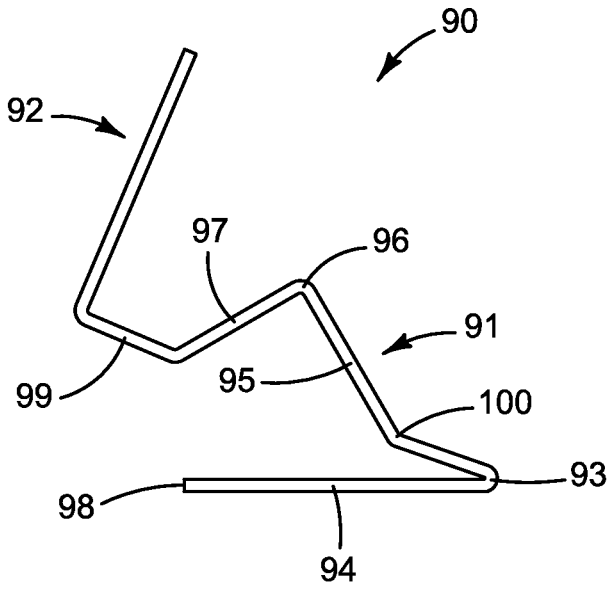
FIG. 15 is a side view of a second exemplary clip.

FIG. 14 illustrates another exemplary shoe system 110 which comprises a toe cover vamp 17 configured for attachment, through a plurality of clips, to a shoe base. This exemplary shoe system 110 illustrated as having a first channel 30, a second channel 130, and a third channel 230. Matching channels (not illustrated) could be provided on the opposite side of the midsole 14. The vamp 17 connecting with a first clip 260 and a second clip 261 via fasteners 184. The first clip 260 illustrated as connecting with the first channel 30, and the second clip 261 illustrated as connecting with the second channel 130.

Referring now to FIG. 15, illustrated is another exemplary design for a clip 90. Clip 90 is similar to clip 60, except that the fixed leg 95 has a bend 100 defined therein for increasing the resiliency of the fixed leg 95 as it relates to the deflectable leg 94. The addition of the bend 100 strengthening the spring over repeated uses. A skilled artisan would be able to, if necessary, change the cross-sectional shape of the channel to better utilize the shape of a clip utilized.

The clip 90 having a locking portion 91 for locking into a channel, and a connector portion 92 for connecting with one or more vamps. The clip 90 comprises a locking portion 91 connected to a connector portion 92. The locking portion 91 is configured for insertion through an opening and into an elongated channel, locking therein. The locking portion 91 comprises an end 98, a deflectable leg 94, a nose 93, fixed leg 95, a locking corner 96, an upright 97, and, where necessary, an extension 99. The extension 99 for allowing the locking portion to extend past the overhang and connect with the connector portion 92. The deflectable leg 94 terminates in the end 98. The deflectable leg 94 attaches to the fixed leg 95 at the nose 93. The upright 97 connects with the extension 99. The extension 99 attaches to a vertical spacer which is part of the connector portion 92.

In the illustrated clip 90, the locking portion 91 is generally right triangular in shape, with the deflectable leg 94 oriented along the hypotenuse of the generally right triangular shape. It is preferred that the deflectable leg 94 be shorter than the fixed leg 95. The deflectable leg 94 can be deflected towards the fixed leg 95 when inserted into the opening, and when removed from the opening. Connector portion 92 comprises one or more connectors for connecting with a vamp via a fastener or other connection device/method. The connector portion 92 connects with the locking portion 91 at the upright 97 and/or at the extension 99/vertical spacer.

Vamps utilized with the exemplary systems could include uppers and/or straps. One or more vamps could be present, in any combination of uppers and/or straps. It is preferred that the detachable vamps be interchangeable regardless of style of shoe base. Vamps can be made of various materials. Size and design of vamps and straps will vary and can be purchased by the wearer separately from the shoe system. Additional customizable components, such as bows or buckles can be added to the vamps or straps.

In an exemplary shoe system, the shoe base may be available in various colors, styles, and sizes. Further, the shoe base can be sold separately from the vamp and other components.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the claims.

Any suitable materials can be used to form the various components of the system, and a skilled artisan will be able to select appropriate materials for a shoe system according to a particular embodiment based on various considerations The foregoing detailed description provides exemplary embodiments of the invention and includes the best mode for practicing the invention. The description and illustration of these embodiments is intended only to provide examples of the invention, and not to limit the scope of the invention, or its protection, in any manner.

What is claimed is:

1. A shoe system comprising:

a shoe comprising a midsole portion, said midsole portion comprising a top surface below an insole, a bottom surface above an outsole, and a sidewall surface in between said top surface and said bottom surface and extending around said shoe substantially perpendicularly to the top surface and the bottom surface and at least one elongated channel defined in and extending along at least a portion of said sidewall surface, said elongated channel comprising an opening into a channel chamber, said elongated channel comprising a roof portion and a base portion and wherein said roof portion and base portion selectively engage a clip between them in a locking fashion;

said clip comprises a locking portion for engaging the roof portion of said elongated channel in order to selectively lock within said elongated channel, said clip connecting with a detachable upper via a connection portion; and said detachable upper comprises an attachment portion for connecting with said connection portion via a connector.

2. The shoe system of claim 1, wherein said at least one elongated channel extends around the entirety of said shoe.

3. The shoe system of claim 1, wherein said at least one elongated channel comprises a first channel on an outside portion of said sidewall surface and a second channel on an inside portion of said sidewall surface.

4. The shoe system of claim 1, wherein said locking portion nests within said elongated channel when locked therein.

5. The shoe system of claim 1, wherein said elongated channel is generally right triangular in shape.

6. The shoe system of claim 5, wherein said generally right triangular shape comprises said base portion, and said roof portion comprises an upwardly extending portion and a downwardly extending portion.

7. The shoe system of claim 6, wherein said generally right triangular shape has a hypotenuse, wherein said base portion is oriented along said hypotenuse, and wherein said opening is defined through an acute corner of said generally right triangular shape.

8. The shoe system of claim 1, wherein said locking portion is configured for insertion through said opening and into said channel chamber.

9. The shoe system of claim 8, wherein said locking portion is generally right triangular shaped, comprising a deflectable leg connecting to a fixed leg at a nose, the fixed leg connecting to an upright at a locking corner, and wherein said opening is located between the upright and the deflectable leg.

10. The shoe system of claim 9, wherein said generally right triangular shape has a hypotenuse, said deflectable leg is oriented along the hypotenuse of said generally right triangular shape wherein said deflectable leg is shorter than said fixed leg, and wherein said deflectable leg can be deflected towards the fixed leg when inserted into said opening and said deflectable leg can be deflected towards the fixed leg when removed from said opening.

11. The shoe system of claim 10, wherein said connector portion further connects with said upright.

12. The shoe system of claim 10, wherein said clip can be locked into said elongated channel by inserting said nose through said opening with said deflectable leg adjacent said base, wherein as it is inserted said deflectable leg will deflect towards said fixed leg until the locking corner passes an overhang rim and the locking portion is able to snap into said elongated channel as the deflectable leg resiliently deflects away from said fixed leg; and wherein said clip can be removed from said elongated channel by applying downward pressure on the connection portion thereby moving the fixed leg towards the deflectable leg and allowing the locking corner to be drawn past the overhang rim and through the opening.

13. A shoe system, said shoe system comprising a shoe, a clip, and at least one detachable upper, wherein:

said shoe comprises a midsole portion, said midsole portion comprising a top surface below an insole, a bottom surface above an outsole, and a sidewall surface in between, and substantially perpendicular to, said top surface and said bottom surface and at least one elongated channel defined in and extending around said sidewall surface, said elongated channel comprising an opening, said elongated channel comprising a roof portion and a base portion that selectively engage said clip between them in a locking fashion;

said clip comprises a locking portion for engaging the roof portion and locking within said elongated channel, said clip connecting with said detachable upper via a connection portion, said locking portion is configured for insertion through said opening and into said elongated channel, wherein said locking portion is generally right triangular shaped, comprising a deflectable leg connecting to a fixed leg at a nose, and the fixed leg connecting to an upright at a locking corner, wherein said opening is located between the upright and the deflectable leg; and said detachable upper comprises an attachment portion for connecting with said connection portion via a connector.

14. The shoe system of claim 13, wherein said generally right triangular shape has a hypotenuse, wherein said deflectable leg is oriented along the hypotenuse of said generally right triangular shape wherein said deflectable leg is shorter than said fixed leg, and wherein said deflectable leg can be deflected towards the fixed leg when inserted into said opening and wherein said deflectable leg can be deflected towards the fixed leg when removed from said opening.

15. The shoe system of claim 14, wherein said connector portion further connects with said upright.

16. The shoe system of claim 14, wherein said clip can be locked into said elongated channel by inserting said nose through said opening with said deflectable leg adjacent said base, wherein as it is inserted said deflectable leg will deflect towards said fixed leg until the locking corner passes an overhang rim and the locking portion is able to snap into said elongated channel as the deflectable leg resiliently deflects away from said fixed leg; and wherein said clip can be removed from said elongated channel by applying downward pressure on the connector portion thereby moving the fixed leg towards the deflectable leg and allowing the locking corner to be drawn past the overhang rim and through the opening.

17. The shoe system of claim 13, wherein said at least one elongated channel extends around the entirety of said shoe.

18. The shoe system of claim 13, wherein said at least one elongated channel comprises a first channel on an outside portion of said sidewall surface and a second channel on an inside portion of said sidewall surface.

19. The shoe system of claim 18, wherein said generally right triangular shape of said locking portion has a hypotenuse, wherein said elongated channel is generally right triangular in shape, comprising a base portion, an upwardly extending roof portion and a downwardly extending roof portion, wherein said base portion is oriented along the hypotenuse of said generally right triangular shape, and wherein said opening is defined through an acute corner of said generally right triangular shape.

20. A shoe system, said shoe system comprising a shoe, a clip, and at least one detachable upper, wherein:

said shoe comprises a midsole portion, said midsole portion comprising a top surface below an insole, a bottom surface above an outsole, and a sidewall surface in between, and substantially perpendicular to, the top surface and the bottom surface, and at least one elongated channel defined in and extending along at least a portion of said sidewall surface, said elongated channel comprising an opening, said elongated channel comprising a roof portion and a base portion and wherein said roof portion and said base portion selectively engage said clip between them in a locking fashion, wherein said elongated channel is generally right triangular in shape, comprising said base portion, said roof portion comprising an upwardly extending portion and a downwardly extending portion, and an overhang comprising an overhang rim, wherein said base portion is oriented along the hypotenuse of said generally right triangular shape, and wherein said opening is defined through an acute corner of said generally right triangular shape;

said clip comprises a locking portion for engaging the roof portion and locking within said channel, said clip connecting with said detachable upper via a connection portion, said locking portion configured for insertion through said opening and into said elongated channel, wherein said locking portion is generally right triangular shaped, comprising a deflectable leg connecting to a fixed leg at a nose, the fixed leg connecting to an upright at a locking corner, and wherein said opening is located between the upright and the deflectable leg, wherein said deflectable leg is oriented along the hypotenuse of said generally right triangular shape, wherein said deflectable leg is shorter than said fixed leg, and wherein said deflectable leg can be deflected towards the fixed leg when inserted into said opening and when removed from said opening, wherein said connector portion further connects with said upright, wherein said clip can be locked into said channel by inserting said nose through said opening with said deflectable leg adjacent said base, wherein as it is inserted said deflectable leg will deflect towards said fixed leg until the locking corner passes the overhang rim and the locking portion is able to snap into the channel as the deflectable leg is resiliently deflected away from said fixed leg; and wherein said clip can be removed from said channel by applying downward pressure on the connector portion thereby moving the fixed leg towards the deflectable leg and allowing the locking corner to be drawn past the overhang rim and through the opening; and said detachable upper comprises an attachment portion for connecting with said connection portion via a connector.

* * * * *